US006971290B1

(12) United States Patent
Ybarra

(10) Patent No.: US 6,971,290 B1
(45) Date of Patent: Dec. 6, 2005

(54) ADJUSTABLE EXTENSION FOR SOCKET WRENCHES

(76) Inventor: Luis M. Ybarra, 1607 Maple St., Granite City, IL (US) 62040

( * ) Notice: Subject to any disclaimer, the term of this patent is extended or adjusted under 35 U.S.C. 154(b) by 0 days.

(21) Appl. No.: 10/627,225

(22) Filed: Jul. 25, 2003

Related U.S. Application Data

(63) Continuation-in-part of application No. 10/223,870, filed on Aug. 20, 2002, now abandoned.

(51) Int. Cl.[7] ..... B25G 1/04
(52) U.S. Cl. ..... 81/177.2; 403/109.3
(58) Field of Search ..... 81/177.2, 177.85, 81/177.1; 16/110.1, 111.1, 405; 403/104, 403/109.1, 109.2, 109.3, 330

(56) References Cited

U.S. PATENT DOCUMENTS

| | | | | |
|---|---|---|---|---|
| 510,981 A | | 12/1893 | Massey | |
| 1,493,983 A | | 5/1924 | Hurley | |
| 2,438,633 A | | 3/1948 | Condor | |
| 2,963,930 A | | 12/1960 | Clothier et al. | |
| 3,227,015 A | | 1/1966 | Tremblay | |
| 3,306,639 A | * | 2/1967 | Lyon | 81/177.2 |
| 4,344,340 A | | 8/1982 | Erickson | |
| 4,367,663 A | | 1/1983 | Merics | |
| 4,376,397 A | | 3/1983 | Newby et al. | |
| 4,409,866 A | * | 10/1983 | McBride | 81/177.2 |
| 4,703,677 A | | 11/1987 | Rossini | |
| 4,754,670 A | | 7/1988 | Raymond | |
| 4,905,548 A | | 3/1990 | Colace et al. | |
| 4,960,015 A | * | 10/1990 | Mathews | 81/177.2 |
| 5,033,337 A | | 7/1991 | Thomas, III | |
| 5,138,911 A | | 8/1992 | Lan | |
| 5,168,782 A | | 12/1992 | Cromwell | |
| 5,361,655 A | * | 11/1994 | Fowlkes | 81/177.2 |
| 5,690,006 A | | 11/1997 | Pulliam | |
| 5,927,161 A | | 7/1999 | Clifford et al. | |
| 5,931,065 A | * | 8/1999 | Jackson et al. | 81/177.2 |
| 6,038,946 A | * | 3/2000 | Jackson et al. | 81/177.2 |

* cited by examiner

*Primary Examiner*—Hadi Shakeri
(74) *Attorney, Agent, or Firm*—Grace J. Fishel

(57) ABSTRACT

An adjustable extension for driving tools has a telescoping body. The telescoping body has an outer member which may be driven by a conventional driver, such as a ratchet handle or by a powered driver. The outer member drives a longitudinally extending inner member which is telescoped within the outer member. The inner and outer members have detents or a rack and pawl to firmly position the members at the desired length. The inner and outer members may be spaced to prevent binding of the elements when subjected to heavy torque loads and have stops to limit the telescoping movement of the elements.

20 Claims, 3 Drawing Sheets

ADJUSTABLE EXTENSION FOR SOCKET WRENCHES

This application is a continuation-in-part of U.S. application Ser. No. 10/223,870, filed Aug. 20, 2002 now abandoned, for Adjustable Extension for Socket Wrenches.

BACKGROUND OF THE INVENTION

1. Field of the Invention

The present invention relates to mechanical tools for driving fasteners and particularly to extensions for tools for driving fasteners.

2. Brief Description of the Prior Art

It is common to have rod like extensions for tool drivers, such as conventional socket wrenches and the like. Often it is necessary to have a set of extensions of graduated lengths to fit the variety of conditions presented by the particular mechanical arrangement being constructed or repaired. In dealing with a single job it may be necessary to switch extensions several times to complete the work required.

As an alternative, a number of adjustable extensions have been considered. The disclosures of the following U.S. patents are incorporated by reference herein: U.S. Pat. Nos. 2,438,633, 2,963,930, 4,344,340, 4,367,663, 4,905,548, 5,033,337, 5,138,911 and 5,927,161.

BRIEF SUMMARY OF THE INVENTION

In view of the above, it an object of the present invention to provide a non-binding, telescoping adjustable extension for driving tools. Other objects and features of the invention will be in part apparent and in part pointed out hereinafter.

In accordance with the present invention, an adjustable extension for socket wrenches is provided. The adjustment is achieved by a telescoping arrangement of the parts of the device that permits the device of the invention to take the place of several extensions of fixed lengths. In addition, the adjustment may be achieved without removing the extension from the driven tool, such as a socket wrench, and from the driver, such as an air wrench, a ratchet driver or other driver such as an Allen key. This function is especially useful if a space in which the work is being performed requires a plurality of extensions as a nut or bolt is tightened or loosened.

The telescoping arrangement of parts preferably uses an outer sleeve having a central bore. The sleeve is adapted to be driven by a conventional driver, such as an Allen key, a ratchet handle, an air wrench or the like. A retractable inner connector is received in the central bore and is adapted to telescope to a variety of lengths, as disclosed herein. The retractable inner connector is adapted to move axially along the length of the outer sleeve in a non-binding manner. The retractable inner connector includes a rack which is engaged by a pawl carried by the sleeve. Pawl locks the retractable inner connector in selected telescoping position within the sleeve.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
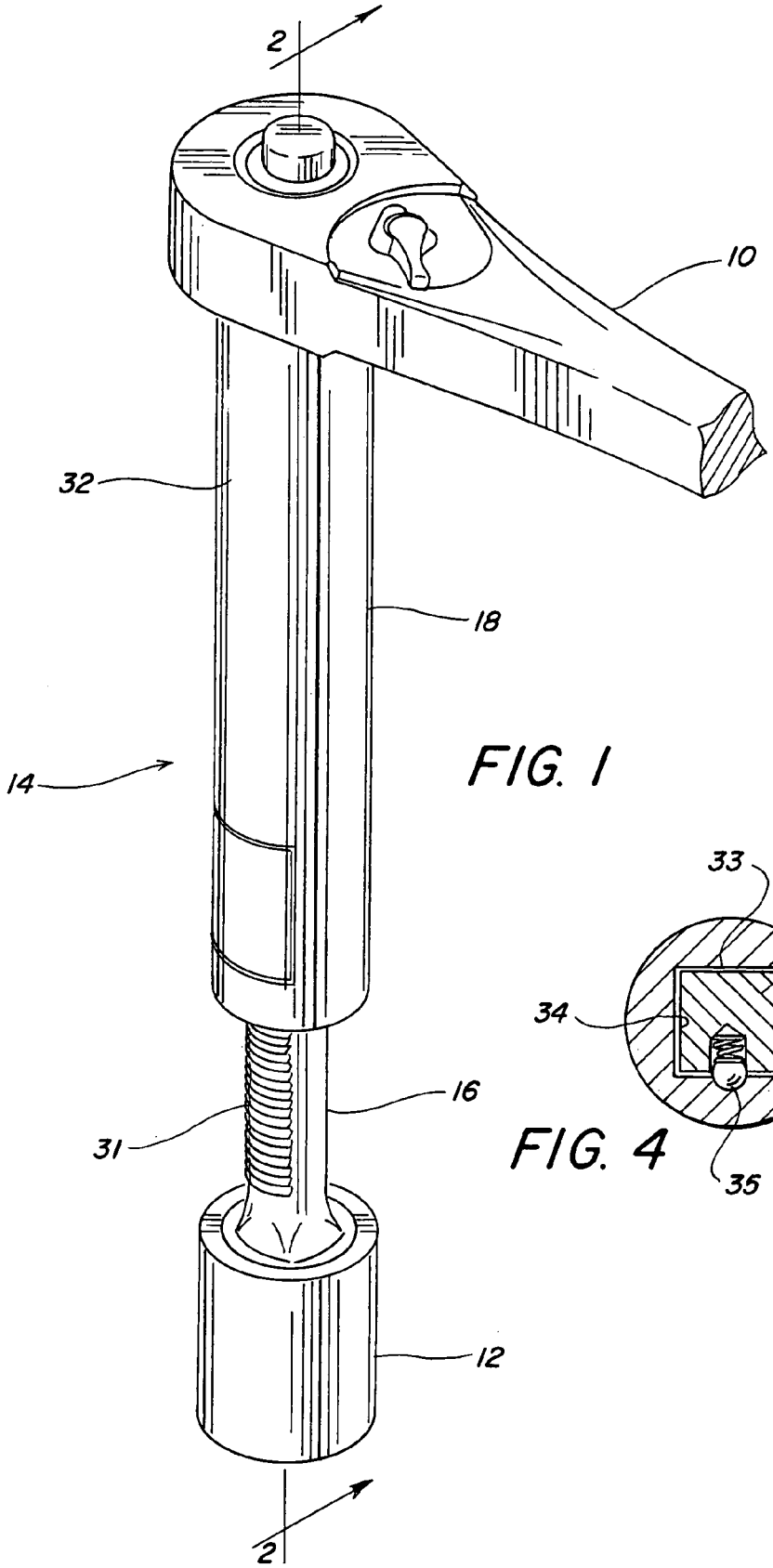
FIG. 1 is a perspective view of an adjustable extension in accordance with the present invention with a conventional ratchet driver and socket wrench.
Figure 2:
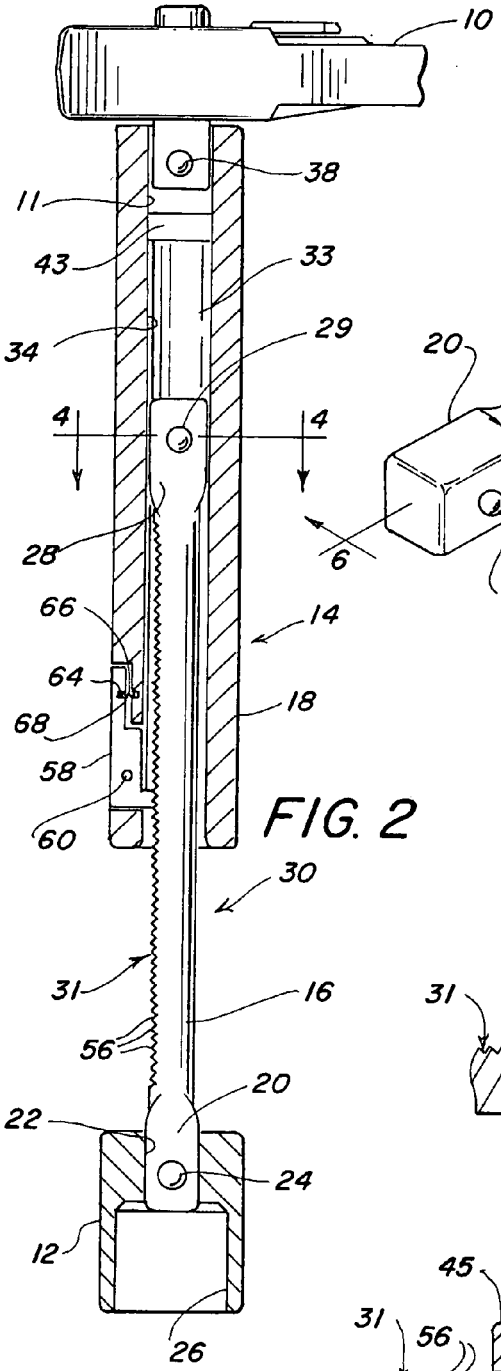
FIG. 2 is a cross-sectional view of the device shown in FIG. 1 taken along the plane 2—2 of FIG. 1.
Figure 3:
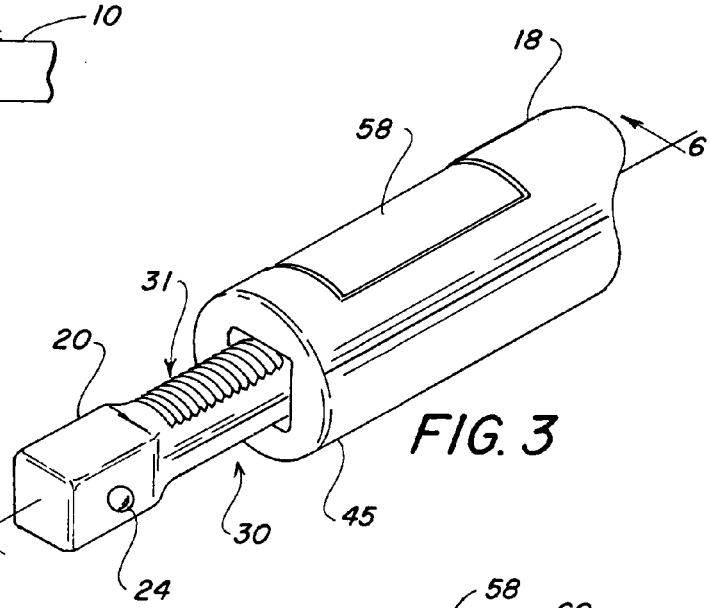
FIG. 3 is a fragmentary perspective view of a distal end of the adjustable extension.
Figure 5:
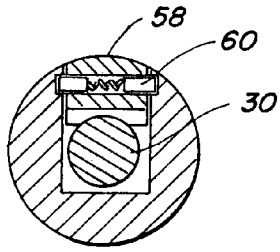
FIG. 5 is a cross-section taken along the plane 5—5 in FIG. 6.

Referring to the drawings more particularly by reference character, as shown in FIGS. 1 and 2, reference numeral 10 refers to a conventional ratchet driver. Ratchet driver 10 is positioned in a receiver 11 to indirectly drive a conventional socket wrench 12. Ratchet driver 10 is connected to socket wrench 12 by an adjustable extension 14. Adjustable extension 14 has a longitudinally extending inner connector 16 and an outer sleeve 18, as shown, and receiver 11 is incorporated in the outer sleeve 18.

Inner connector 16 terminates in a distal driving end 20 which may be received in a complementary shaped recess 22 in socket wrench 12. The shape of recess 22 and distal driving end 20 of inner connector 16 may be square in cross-section. However, it will be appreciated that other shapes may be used; for example, the complementary driving connection may be hexagonal, star shaped and the like.

Distal driving end 20 of inner connector 16 may also be provided with a spring biased detent 24 which provides a firm removable connection between distal driving end 20 of inner connector 16 and recess 22 of socket wrench 12. As is known in the art, recess 22 of socket wrench 12 may have a relieved portion, not shown, which cooperates with spring biased detent 24 to provide a firm removable connection between distal driving end 20 of inner connector 16 and socket wrench 12. Also as is known in the art, socket wrench 12 has a second recess 26 which has a complementary shape for receiving a cooperating fastener, such as a bolt head or a nut, not shown.

Figure 4:
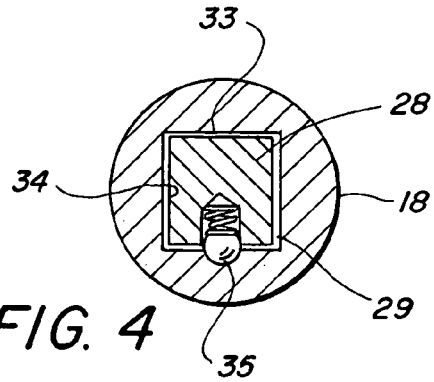
FIG. 4 is a cross-section taken along the plane 4—4 in FIG. 2.

A proximal driven end 28 of inner connector 16 also has a driving shape, which in FIG. 4 is shown as square in cross-section. As described above, this cross-sectional shape may also be of other configurations, such as hexagonal, star shaped, or some other complementary driving shape. Proximal driven end 28 of inner connector 16 may also be provided with a spring biased detent 29 which cooperates with outer sleeve 18 to form a firm removable connection, as described herein. An intermediary portion 30 of inner connector 16 is formed to be narrower than proximal driven end 28 and distal driving end 20 and includes a rack 31. Rack 31 may encircle intermediary portion 30 or be formed as a longitudinal strip, as shown. In a preferred embodiment intermediary portion 30 of inner connector 16 may be circular in cross-section.

As illustrated in the drawings, outer sleeve 18 is substantially tubular, having a cylindrical outer surface 32 and a central cavity 33 which extends longitudinally through outer sleeve 18. The cross-section of central cavity 33 is complementary to the shape of proximal driven end 28 of inner connector 16; that is, the cross-sectional shape of central cavity 33 is generally non-circular. As shown in FIG. 4, central cavity 33 is square in cross-sectional shape and has four longitudinally extending inner walls 34, as shown. However, other complementary driving shapes may be used, including hexagonal, star shaped and others, as described above. It will be appreciated that outer surface 32 of outer sleeve 18 may also be of a non-circular configuration, such as a polygon.

The interior of outer sleeve 18 may be smooth or outer sleeve 18 may have one or more recesses 35 formed in the interior of outer sleeve 18, as seen in FIG. 4. Recesses 35 may cooperate with spring biased detent 29 in proximal driven end 28 of inner connector 16 to form a firm removable connection between outer sleeve 18 and inner connector 16. As an alternative embodiment shown in FIG. 7, outer sleeve 18 may have one or more transverse bores 36 which cooperate with spring biased detent 29 in proximal driven end 28 of inner connector 16. Recesses may also be formed in outer sleeve 18 to cooperate with a spring biased detent 38 in ratchet driver 10, or in other driving means. The terminal bore 36 adjacent to proximal end 42 of outer sleeve 18 may cooperate with spring biased detent 38 of ratchet driver 10, or with another conventional driver, not shown.

As noted herein, intermediary portion 30 of inner connector 16 may be narrower than proximal driven end 28 and distal driving end 20 of inner connector 16. When inner connector 16 is received in central cavity 33 of outer sleeve 18 intermediary portion 30 of inner connector 16 is out of substantial contact with outer sleeve 18. This spaced relationship between outer sleeve 18 and intermediary portion 30 of inner connector 16 permits the inner connector to move freely within outer sleeve 18 to the desired extension length. Further, the spaced relationship between outer sleeve 18 and inner connector 16 provides sufficient compliance to avoid binding, especially when large torque loads are placed on the device of the invention. For example, if there was a close fit along the full extent of inner connector 16 and central cavity 33 of outer sleeve 18, the distortion from a large torque load could cause inner connector 16 to bind in outer sleeve 18 and potentially jam inner connector 16 in outer sleeve 18. This jamming could then interfere with the operation of the device by preventing a desired change in the extension length during use.

As shown in FIG. 2, outer sleeve 18 may have a stop 43 placed in central cavity 33 of outer sleeve 18. Stop 43 may be cast in central cavity 33 of outer sleeve 18 or formed by other conventional means, such as pressing stop 43 into central cavity 33. Stop 43 prevents the inner connector from completely telescoping into central cavity 33 and becoming jammed therein.

Figure 7:
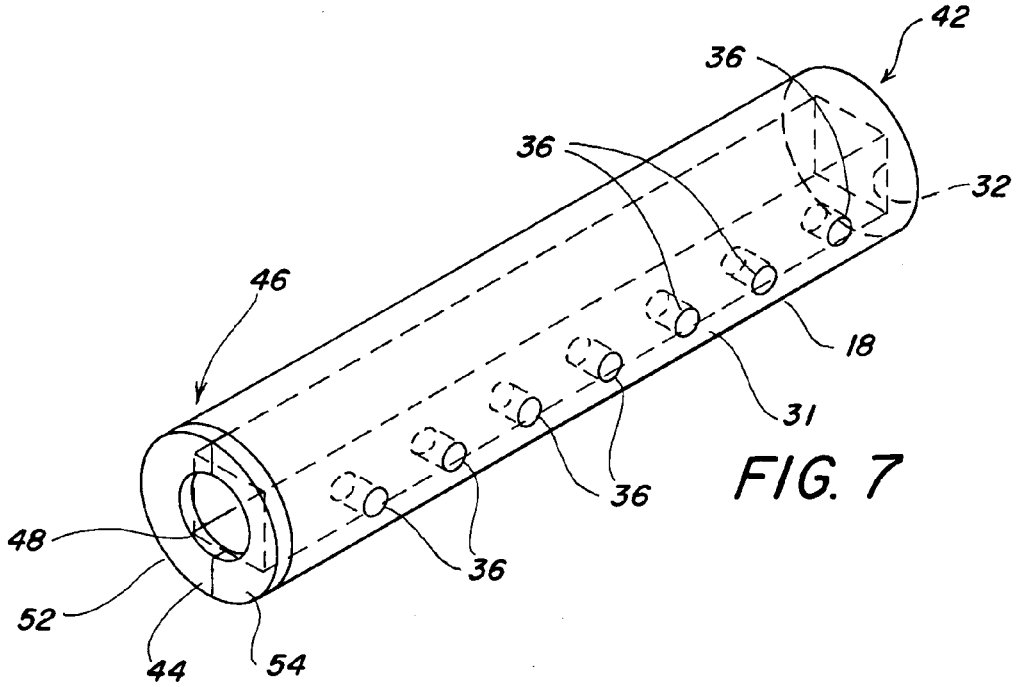
FIG. 7 is a perspective view of an alternative embodiment of the outer sleeve portion of the invention.
Figure 8:
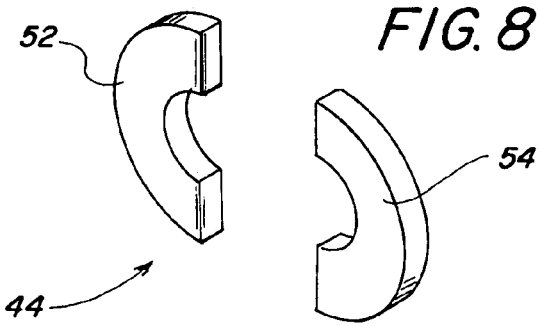
FIG. 8 is a perspective view of an alternative stop as used in the outer sleeve shown in FIG. 7; and, FIG. 9 is a partial front plan view of an alternative embodiment of the inner connector of the invention.
Figure 9:
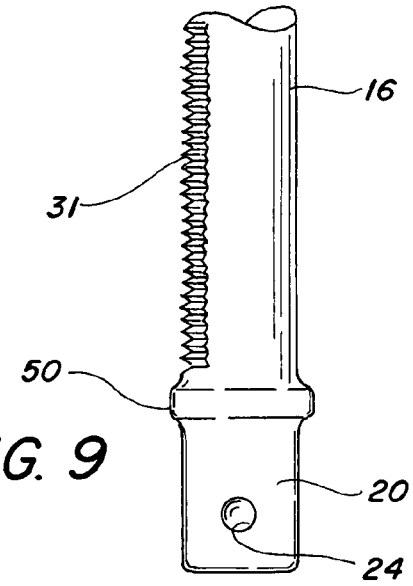

A circular stop 44, seen in FIGS. 7 and 8, may be attached to a distal end 45 of outer sleeve 18. Circular stop 44 has an opening 48 which receives inner connector 16 therethrough. As shown in FIGS. 7–8, opening 48 is circular and is sized to collar intermediary portion 30 of inner connector 16, but not to bind inner connector 30. When extension 14 of the invention is fully contracted, distal driving end 20 of inner connector 16 abuts against circular stop 44 and is prevented from fully entering central cavity 33 of outer sleeve 18. As shown in FIG. 9, inner connector 16 may have a modified distal driving end 20. An abutting member, such as a flange or shoulder 50, may be added to distal driving end 20 of inner connector 16. Flange or shoulder 50 abuts against distal end 45 of outer sleeve 18, or against circular stop 44, when inner connector 16 is retracted into central cavity 33 of outer sleeve 18.

With reference to FIG. 8, circular stop 44 may be formed of a plurality of parts, such as the two elements 52 and 54 to simplify the assembly of extension 14. Proximal driven end 28 of inner connector 16 is first inserted into central cavity 33 of outer sleeve 18. Elements 52 and 54 are then attached on distal end 45 of outer sleeve 18 by any conventional means, such as by the use of adhesives, by welding, by using fasteners such as machine screws and so forth. Distal end 45 of outer sleeve 18 may be provided with an upstanding flange, not shown, to encompass the periphery of circular stop 44, if desired.

Figure 6:
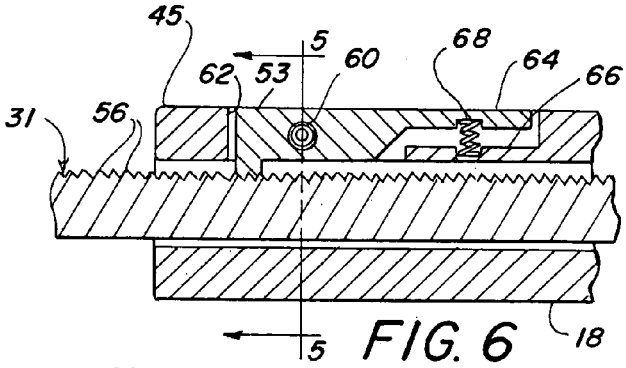
FIG. 6 is a cross-section taken along the plane 6—6 in FIG. 3.
Figure 6A:
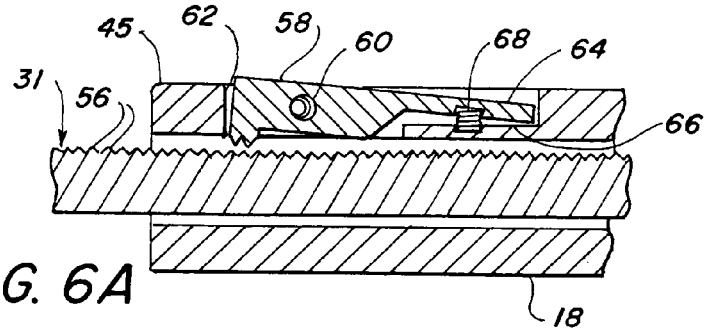
FIG. 6A is similar to FIG. 6 but showing the pawl released from the ratchet teeth.

As shown in the drawings, rack 31 is formed along intermediate portion 30 of inner connector 16. Rack 31 includes a plurality of teeth 56 and a pawl 58 which fits into one or more of teeth 56. When teeth 56 are not sloped as shown in FIG. 6, pawl 58 prevents either forward or backward movement of inner connection 16. When teeth 56 are sloped (i.e., ratchet teeth) and depending on the direction of the slope, pawl 58 will allow forward or backward movement of intermediate portion 30 in sleeve 18 but resist movement in the opposite direction. Pawl 58 as shown in the drawings is pivoted on a spring biased axle 60 which is received in a window 62 formed in sleeve 18 near or at distal end 45. Pawl 58 includes an extension 64 which is notched 66 into sleeve 18. A spring 68 acting against extension 64 and notch 66 biases pawl 58 into engagement with teeth 56. To release pawl 58, as shown in FIG. 6A, a downward pressure is applied on extension 64 compressing spring 68. Intermediate portion 30 can then move freely in sleeve 18.

Extension 14 of the invention may be made from conventional durable and sturdy material such as stainless steel, tool steel or tool alloys such as chrome vanadium which does not rust. It may be fabricated by a wide variety of conventional metal working techniques, including but not limited to extruding, machining, casting, forging, welding and combinations of these techniques.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed is:

1. An adjustable extension for driving tools comprising an outer member, the outer member having a proximal end and a distal end, the adjustable extension having a longitudinally extending connector, the longitudinally extending connector having a proximal end and a distal end, the outer member having a receiver at the proximal end thereof for receiving a driving tool, the outer member having a longitudinally extending central cavity, the central cavity having a tool driving element, the adjustable extension further having the proximal end of the longitudinally extending connector adjustably received within the longitudinally extending central cavity of the outer member for relative telescoping movement thereto, the proximal end of the longitudinally extending connector having a driven element cooperating with the tool driving element of the outer member, the distal end of the longitudinally extending connector extending out of the longitudinally extending central cavity and beyond the distal end of the outer member, the distal end of the longitudinally extending connector having a member for driving a tool, the longitudinally extending connector having an intermediate portion between its proximal and distal ends, the intermediate portion of the longitudinally extending connector including a rack with teeth, the intermediate portion of the longitudinally extending connector being spaced from the central cavity of the outer member in a non-binding relationship, the outer member having a notch opening to a window in which is received a pawl with a handle extension substantially flush with the outer member, said pawl and handle extension mounted on a spring biased axle in the window, and a spring between said handle extension and the notch to bias said pawl for engagement with one or more of the teeth of the rack whereby the adjustable extension may be used in a selected variety of extended lengths to connect the proximal end of the outer member to a driving tool and transmit driving force to a tool connected to the tool driving member at the distal end of the longitudinally extending connector.

2. The device of claim 1 wherein the adjustable extension has a stop to limit the relative telescoping movement of the outer member and the longitudinally extending connector.

3. The device of claim 1 wherein the outer member has a stop in the longitudinally extending central cavity adjacent to the proximal end of the outer member to limit the relative telescoping movement of the outer member and the longitudinally extending connector.

4. The device of claim 1 wherein the outer member has a stop at the distal end of the outer member to limit the relative telescoping movement of the outer member and the longitudinally extending connector.

5. The device of claim 4 wherein the stop Includes a guide member at the distal end of the outer member.

6. The device of claim 1 wherein the longitudinally extending connector has a stop adjacent to the distal end of the longitudinally extending connector to limit the relative telescoping movement of the outer member and the longitudinally extending connector.

7. The device of claim 6 wherein the stop includes an enlarged portion adjacent to the distal end of the longitudinally extending connector.

8. The device of claim 1 wherein the tool driving element of the central cavity has a square drive configuration.

9. The device of claim 1 wherein the driven element of the longitudinally extending connector has a square drive configuration.

10. The adjustable extension of claim 1 wherein the adjustable extension includes a spring biased detent to form a firm removable connection between the outer member and the longitudinally extending connector.

11. An adjustable extension for driving tools comprising an outer tubular member, the outer tubular member having a proximal end and a distal end, the adjustable extension having a longitudinally extending connector, the longitudinally extending connector having a proximal end and a distal end, the outer tubular member having a receiver at the proximal end thereof for receiving a driving tool, the tubular member having a longitudinally extending central cavity, the central cavity having a non-circular cross-section, the adjustable extension further having the longitudinally extending connector adjustably received within the longitudinally extending central cavity of the tubular member for relative telescoping movement thereto, the longitudinally extending connector having its proximal end received within the central cavity of the tubular member, the proximal end of the longitudinally extending connector having a non-circular cross-sectional shape cooperating with the central cavity of the tubular member, the longitudinally extending connector having its distal end extending out of the longitudinally extending central cavity and beyond the distal end of the tubular member, the distal end of the longitudinally extending connector having a tool driving member, the longitudinally extending connector having an intermediate portion between its proximal and distal ends, the intermediate portion of the longitudinally extending connector being substantially circular in cross-section and being of a smaller transverse dimension than the proximal end of the longitudinally extending connector, the intermediate portion of the longitudinally extending connector being spaced from the central cavity of the outer tubular member in a non-binding relationship and including a rack with a plurality of teeth, the distal end of at least one of the tubular member and the longitudinally extending connector having a stop to limit the relative telescoping movement of the adjustable extension, the tubular member having a notch opening to a window in which is received a pawl with a handle extension substantially flush with the tubular member, said pawl and handle extension mounted on a spring biased axle in the window, and a spring between said handle extension and the notch to bias said pawl for engagement with one or more of the teeth of the rack adjacent the distal end of the tubular member, whereby the adjustable extension may be used in a selected variety of extended lengths to connect the proximal end of the tubular member to a driving tool and transmit driving force to a tool connected to the tool driving member at the distal end of the longitudinally extending connector.

12. The adjustable extension of claim 11 wherein the stop includes a flange adjacent to the distal end of the longitudinally extending connector.

13. The adjustable extension of claim 11 wherein the stop includes a guide member adjacent to the distal end of the outer tubular member, the guide member collaring the intermediate portion of the longitudinally extending connector.

14. The adjustable extension of claim 11 wherein the adjustable extension includes a plurality of selectively engageable connections to form a plurality of firm selectively removable connections between the outer tubular member and the longitudinally extending connector.

15. The adjustable extension of claim 11 wherein the central cavity of the outer tubular member has a square drive configuration and wherein the proximal end of the longitudinally extending connector has a cooperating square configuration.

16. An adjustable extension for driving tools comprising an outer member, the outer member having a proximal end and a distal end, the adjustable extension having a longitudinally extending connector, the longitudinally extending connector having a proximal end and a distal end, the outer member having means for connecting to a driving tool at the proximal end thereof, the outer member having means for receiving the longitudinally extending connector for relative telescoping movement thereto, the longitudinally extending connector having a means for cooperating with the outer member to drive the longitudinally extending connector, the distal end of the longitudinally extending connector having means for driving a tool, the longitudinally extending connector having an intermediate portion of smaller dimension between its proximal and distal ends for spacing the intermediate portion of the longitudinally extending connector from the outer member in a non-binding relationship, at least one of the outer member and the longitudinally extending connector having means for limiting the relative telescoping movement of the adjustable extension, said means for limiting relative telescoping movement comprising a rack with a plurality of teeth extending between the proximal end and the distal end of the longitudinally extending connector, said outer member having a notch opening to a window in which is received a pawl with a handle extension substantially flush with the outer member, said pawl and handle extension mounted on a spring biased axle in the window, and a spring between said handle extension and the notch for selective engagement of the pawl with one or more of the teeth of the rack, whereby the adjustable extension may be used in a selected variety of extended lengths to connect the proximal end of the outer member to a driving tool and transmit driving force to a tool connected to the driving means at the distal end of the longitudinally extending connector.

17. The adjustable extension of claim 16 wherein the cooperating drive means is a square drive.

18. The adjustable extension of claim 16 wherein the means for limiting the relative telescoping movement of the adjustable extension includes a stop at an end of the outer member.

19. The adjustable extension of claim 16 wherein the means for limiting the relative telescoping movement of the adjustable extension Includes a guide at the distal end of the outer member.

20. The adjustable extension of claim 16 wherein the means for limiting the relative telescoping movement of the adjustable extension includes a shoulder on the longitudinally extending connector adjacent to the distal end thereof.

* * * * *